US009649546B2

(12) United States Patent
Snyder

(10) Patent No.: US 9,649,546 B2
(45) Date of Patent: May 16, 2017

(54) COLLAPSING PORTABLE APPARATUS FOR THE TRAINING AND ADJUSTMENT OF FORWARD, LATERAL AND ROTATIONAL MOVEMENT IN SPORTS ACTIVITY

(71) Applicant: Wayne Edward Snyder, Winter Springs, FL (US)

(72) Inventor: Wayne Edward Snyder, Winter Springs, FL (US)

(73) Assignee: Power Pivot Golf, LLC, Port Saint Lucie, FL (US)

( * ) Notice: Subject to any disclaimer, the term of this patent is extended or adjusted under 35 U.S.C. 154(b) by 0 days.

(21) Appl. No.: 14/734,752

(22) Filed: Jun. 9, 2015

(65) Prior Publication Data

US 2016/0016062 A1 Jan. 21, 2016

Related U.S. Application Data

(60) Provisional application No. 62/025,266, filed on Jul. 16, 2014.

(51) Int. Cl.
*A63B 69/36* (2006.01)
*A63B 69/00* (2006.01)

(52) U.S. Cl.
CPC ..... *A63B 69/3608* (2013.01); *A63B 69/0057* (2013.01); *A63B 69/3667* (2013.01);
(Continued)

(58) Field of Classification Search
USPC ..... 473/215, 217, 218, 266, 270–277, 409
See application file for complete search history.

(56) References Cited

U.S. PATENT DOCUMENTS 4,651,994 A * 3/1987 Lee ..... A63B 69/3608 473/271
5,591,090 A * 1/1997 Kauffman, Jr. .... A63B 69/0057 473/271

(Continued)

*Primary Examiner* — Nini Legesse
(74) *Attorney, Agent, or Firm* — Antonio G. Tapia

(57) ABSTRACT

A collapsing portable apparatus for the training and adjustment of forward, lateral and rotational movement in sports activity which is portable, adjustable, collapsible when not in use, not attached to the user's body, stops unwanted forward, lateral and rotational movement, provides tactile feedback for learning while training, immediately provides the user with positive feedback, initiates resistance necessary to hit a ball correctly, and can be used indoors, in practice areas, or in the field. The device essentially comprises a main vertical body which is substantially mandolin shaped and has an upper neck and a lower bout. A leg arch is attached to the upper neck and an elongated runner is attached to the lower bout. Near to a nexus of the neck and lower bout, a support strut extends from the main vertical body and connects to the elongated runner to create a rigid apparatus for use. Each of the parts of the apparatus are configured in a way where the user may dissemble it when the device is not in use by way of manipulating a plurality of attaching and hinge means. This device is believed to be useful in a variety of sports training settings such as golf greens and batter's boxes, where the individual athlete user desires assistance to perfect a sports task such as a golf downswing or home run hit. A device according to the invention is also believed to be favorable for use in gym environments, classes and other fitness-related facilities.

5 Claims, 12 Drawing Sheets

(52) U.S. Cl.
CPC ..... *A63B 2069/0008* (2013.01); *A63B 2069/0062* (2013.01); *A63B 2210/50* (2013.01); *A63B 2225/093* (2013.01)

(56) References Cited

U.S. PATENT DOCUMENTS

| | | | | |
|---|---|---|---|---|
| 8,152,650 | B1 | 4/2012 | Brandt | |
| 2006/0122003 | A1* | 6/2006 | Kim | A63B 69/0057 473/271 |

* cited by examiner

COLLAPSING PORTABLE APPARATUS FOR THE TRAINING AND ADJUSTMENT OF FORWARD, LATERAL AND ROTATIONAL MOVEMENT IN SPORTS ACTIVITY

CROSS-REFERENCE TO RELATED APPLICATIONS

This Application claims the benefit of U.S. Provisional Application No. 62/025,266, filing date Jul. 16, 2014.

TECHNICAL FIELD

This invention relates generally to exercise equipment. More specifically this invention relates to portable, collapsing, and adjustable exercise equipment used during training.

BACKGROUND OF THE INVENTION

There are many sports activities where an athlete achieves greatness by being able to repeatedly deliver a seemingly magical chain reaction of powerful, flawless and graceful body movements. One might imagine a pitcher winding his shoulders moments before a game winning pitch. One can visualize the elegant but powerful rotation of a golfer's body as she drives a ball down the green. A tennis player might twist into a backhand and deliver it explosively over the net with precision. In each of these scenarios, the athlete must train for many years repeatedly executing the same swing, pitch or throw in order to create muscle memory, flexibility, power and instant recall of game winning stances, positions and plays.

However, many times improper foot position, body swaying or other movement decreases the power or precision of the athlete. Because many of these unwanted nuances happen so quickly it is often hard for the athlete to be aware of and eliminate performance limiting defects when practicing. Largely this is because there is little or no tactile feedback from which the athlete can gain valuable insight when performing a sports activity. Most often athletes rely an outside observer such as coach to watch and advise—but a mere observer cannot offer better insight than the athletes internal self-awareness of her body during practice.

In the applicant's experience there is a deficiency in the existing and prior art wherein there are no sufficiently lightweight, portable, adjustable and collapsible devices that can be used to consistently provide instant and direct tactile feedback to the individual athlete during training which helps her become more aware of body position and attenuate unwanted lateral, forward and rotational movement.

As an example, a successful golf backswing entails a correct order of orchestrated movement between the player's hands, arms, shoulders and hips. The golfer takes position, waggles, returns to address and then swings to the top of the backswing—all the while maintaining relative variable amounts of turn of his shoulders and hips throughout the sequential stages of the backswing. During the first part of the swing, the hands arms and shoulders start the club backwards along a plane which inclines upward from the ball through the shoulders. The shoulders turn and begin to wind and twist the hips thereby creating a correct tension in muscles between the shoulders and hips. The hips, a pivotal element, turn and initiate the downswing and release the body, legs and arms in a cohesive movement. Each part contributes to the increasing speed and power of the swing. And so the power and precision follows from the shoulders to the hands and through the club and ball.

Unfortunately, it is common for golfers to create unwanted lateral movement or sway during the backswing of a golf club. This lateral movement decreases the golfer's ability to generate necessary resistance in the legs, hips and chest. Without that resistance, the force and leverage necessary to create a powerful weight shift, torso turn and downswing is lost.

In the current art there are some devices used to assist in the training of golf. Most commonly, teaching professionals employ aiming sticks which are typically simple fiberglass rods. These rods are often stuck in or laid down on the ground to provide the training athlete a visual cue like a lane in the green or a window through which to aim. This innovation does not provide and tactile feedback or assist in the cessation of unwanted body movements.

There is also a golf training aid akin to a shoe for golfers recognized by the trade name "PivotPro." This device is a sandal like shoe with straps that is attached to the foot and attempts to adjust posture by employing an angled, wedge-like sole. According to the collateral materials of the manufacture, this device is "designed to be used on the practice range at home or office." This device remains physically attached to the user and any benefits thereof do not remain once the shoe is removed, is limited to golf, cannot be used on the green, and does not provide tactile feedback beyond the foot of the wearer.

Therefore there is a need for a training apparatus that helps an athlete attenuate and extinguish all unwanted lateral, forward and lateral movement. In the instance of the above golfer, such an invention would provide tactile feedback in various places along the athlete's body thereby signaling that the body position is not optimal. This direct tactile feedback would help the golfer to change body position and maintain proper golf face angle through the activity, the golf ball and finish position. The golfer would maintain position through the backswing and feel resistance build in the lower leg. Such an invention would also provide feedback to signal that the hips may be over rotated past forty five degrees or the shoulders past ninety degrees off the target line. This is at least one example of how such an apparatus would address the problems in the prior and current art.

In the applicant's experience, there is a need for a collapsing portable apparatus for the training and adjustment of forward, lateral and rotational movement in sports activity which is i) portable, ii) adjustable, iii) collapsible when not in use, iv) not attached to the user's body, v) stops unwanted forward, lateral and rotational movement, vi) provides tactile feedback for learning while training, vii) immediately provides the user with positive feedback, viii) initiates resistance necessary to hit a ball correctly, and ix) can be used indoors, in practice areas, or in the field. The device of the present invention is believed to accomplish all of the foregoing objectives.

SUMMARY OF THE INVENTION

The present invention provides a new and useful collapsing portable apparatus for the training and adjustment of forward, lateral and rotational movement in sports activity which is portable, adjustable, collapsible when not in use, not attached to the user's body, stops unwanted forward, lateral and rotational movement, provides tactile feedback for learning while training, immediately provides the user with positive feedback, initiates resistance necessary to hit a ball correctly, and can be used indoors, in practice areas, or in the field. This device is believed to be useful in a variety of sports training settings such as golf greens and batter's boxes, where the individual athlete user desires assistance to perfect a sports task such as a golf downswing or home run hit. A device according to the invention is also believed to be favorable for use in gym environments, classes and other fitness-related facilities.

In one of its basic embodiments, the apparatus comprises a main vertical body which is substantially mandolin shaped and has an upper neck and a lower bout. A leg arch is attached to the upper neck and an elongated runner is attached to the lower bout. Near to a nexus of the neck and lower bout, a support strut extends from the main vertical body and connects to the elongated runner to create a rigid apparatus for use. Each of the parts of the apparatus are configured in a way where the user may dissemble it when the device is not in use by way of manipulating a plurality of attaching and hinge means.

When the device is in use during sports related training exercises, a user who is a training athlete first places the assembled apparatus on a training surface such as a golf green or batter's box. The user then places an arch of her foot onto the foot plate end which is located on the elongated runner of the apparatus. Next the user places her lower leg into the leg arch attached to the main vertical body and adjusts the placement of her foot and lower leg to snugly join the leg arch. By being in contact with the device in multiple places along the user's body, the user instantly and continuously receives tactile feedback from the apparatus.

With the user's leg in contact with the apparatus, she begins a sports activity which can be a golf down stroke, racquet backhand or swing of a baseball bat. While training the user can learn from the tactile feedback of the apparatus on the lower leg to note and adjust unwanted forward, lateral and rotational movement during the activity. The user repeats the sports activity while utilizing the tactile feedback of the apparatus until undesirable movement is eliminated.

Thus the present invention provides a new and useful collapsing portable apparatus for the training and adjustment of forward, lateral and rotational movement in sports activity which is i) portable, ii) adjustable, iii) collapsible when not in use, iv) not attached to the user's body, v) stops unwanted forward, lateral and rotational movement, vi) provides tactile feedback for learning while training, vii) immediately provides the user with positive feedback, viii) initiates resistance necessary to hit a ball correctly, and ix) can be used indoors, in practice areas, or in the field. The device of the present invention is believed to accomplish all of the foregoing objectives. Further features and objectives of the present invention will become apparent form the following detailed description and the accompanying drawings.

DETAILED DESCRIPTION OF THE INVENTION

Figure 1:
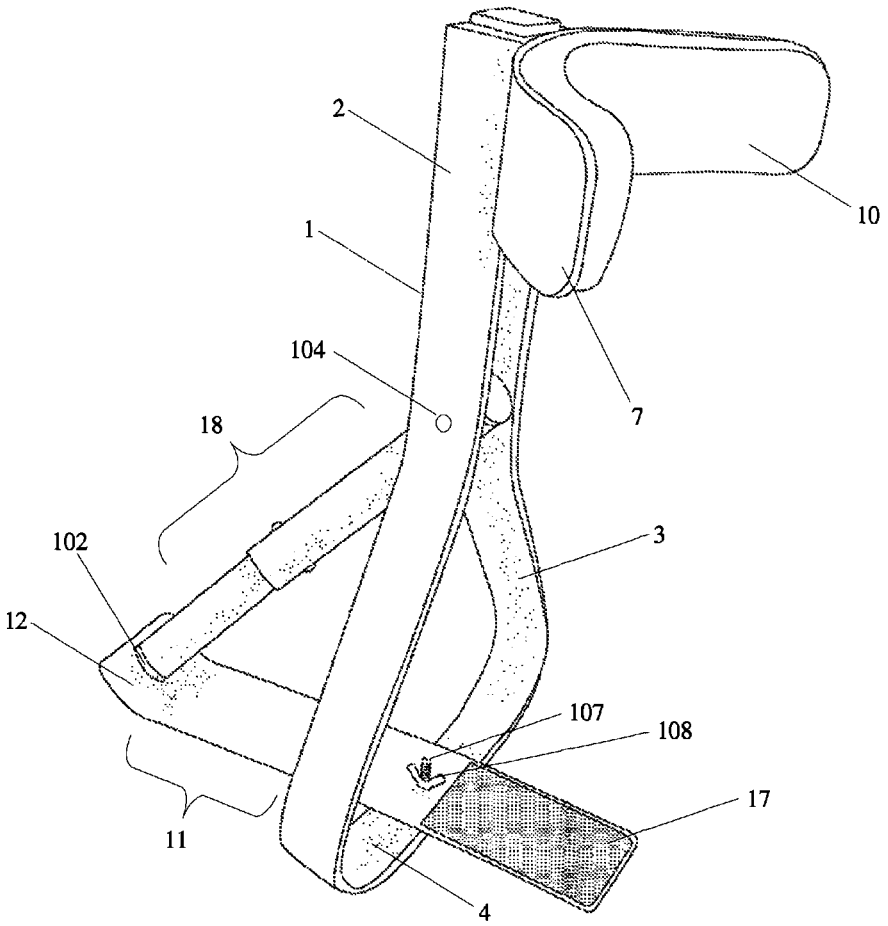
FIG. 1 is an isometric perspective view of a collapsing portable apparatus for the training and adjustment of forward, lateral and rotational movement in sports activity when fully assembled for use according to the present invention.
Figure 2:
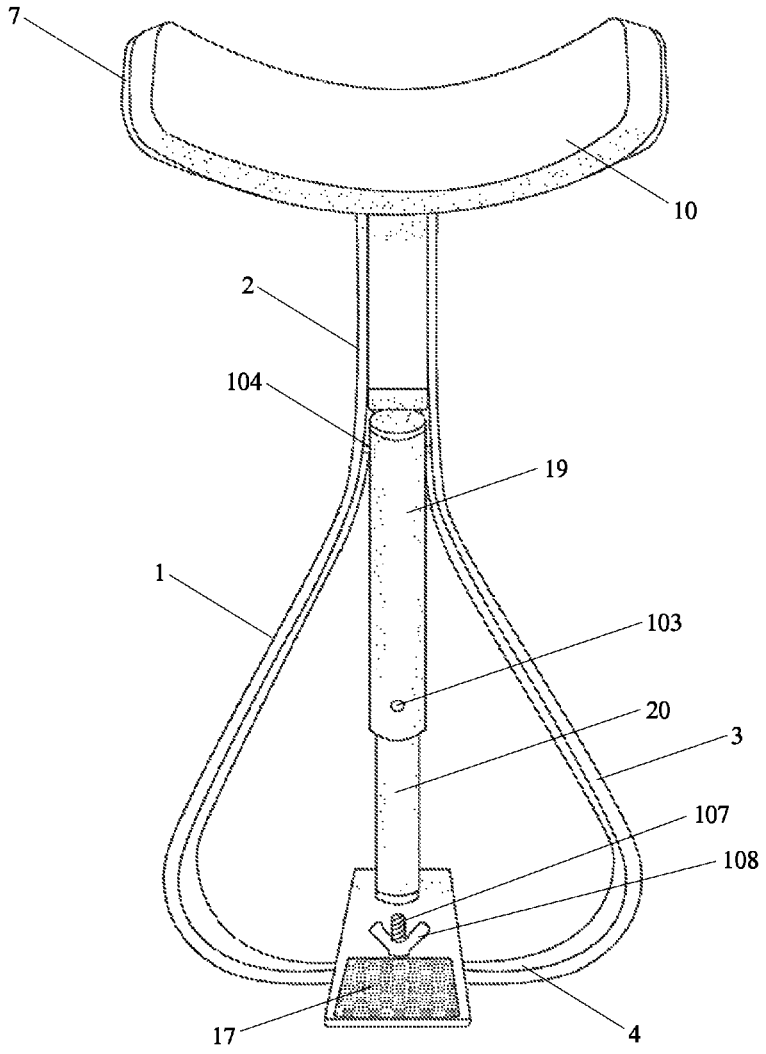
FIG. 2 is a front elevation view of a collapsing portable apparatus for the training and adjustment of forward, lateral and rotational movement in sports activity according to the present invention.
Figure 3:
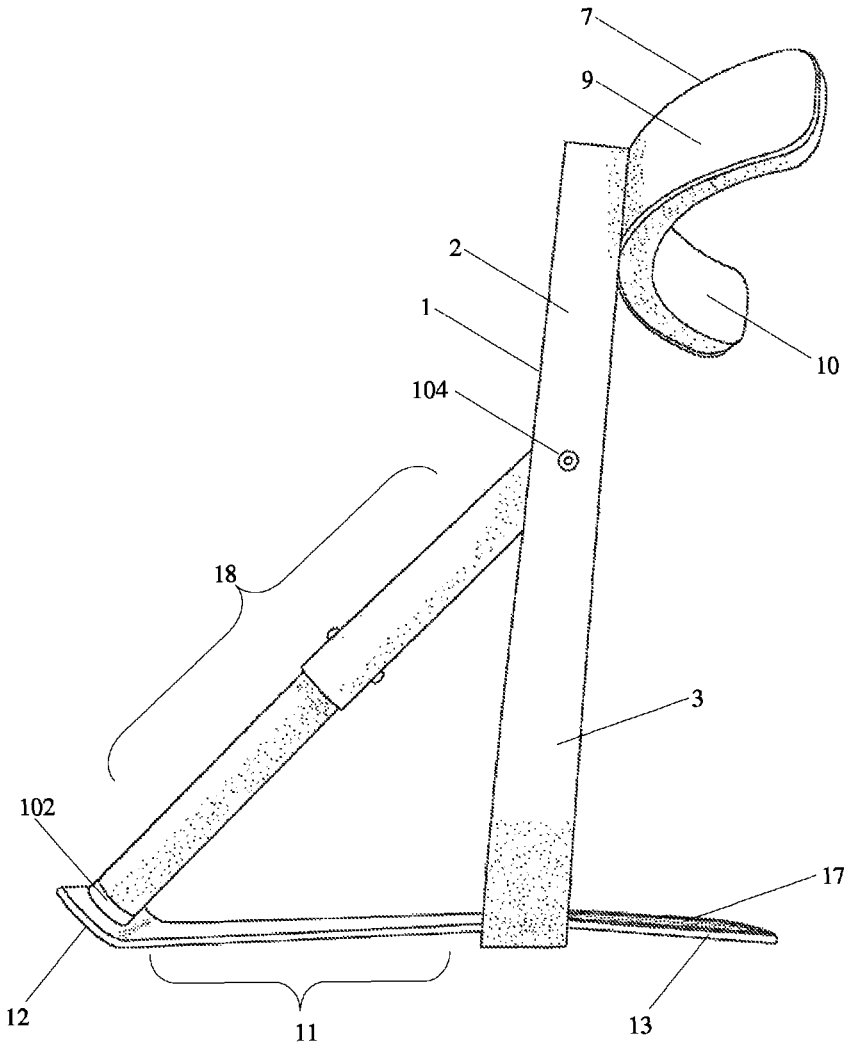
FIG. 3 is a right side elevation view of a collapsing portable apparatus for the training and adjustment of forward, lateral and rotational movement in sports activity according to the present invention.
Figure 4:
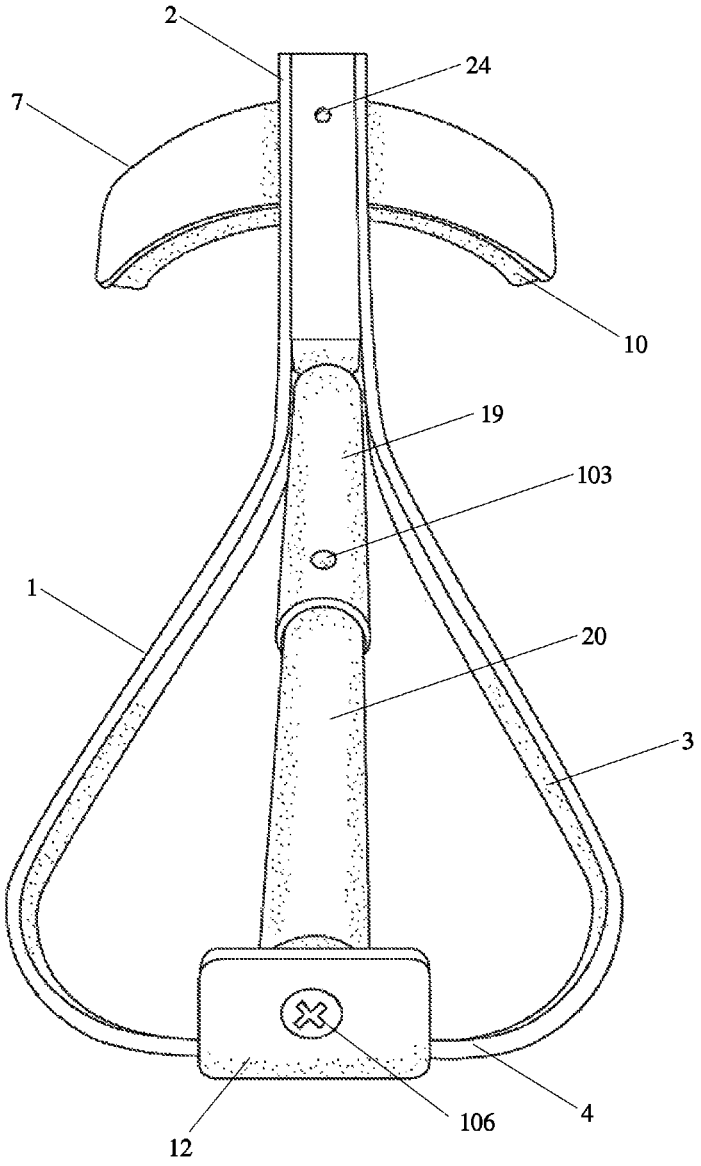
FIG. 4 is a back side elevation view of a collapsing portable apparatus for the training and adjustment of forward, lateral and rotational movement in sports activity according to the present invention.

As described above, the present invention provides a new and useful collapsing portable apparatus for the training and adjustment of forward, lateral and rotational movement in sports activity which is portable, adjustable, collapsible when not in use, not attached to the user's body, stops unwanted forward, lateral and rotational movement, provides tactile feedback for learning while training, immediately provides the user with positive feedback, initiates resistance necessary to hit a ball correctly, and can be used indoors, in practice areas, or in the field. This device is believed to be useful in a variety of sports training settings such as golf greens and batter's boxes, where the individual athlete user desires assistance to perfect a sports task such as a golf downswing or home run hit. A device according to the invention is also believed to be favorable for use in gym environments, classes and other fitness-related facilities. The following description and accompanying drawings disclose at least one version of the device.

Referring now to the invention in more detail in FIG. 1 to FIG. 9 there is shown a collapsing portable apparatus for the training and adjustment of forward, lateral and rotational movement in sports activity which comprises a main vertical body 1 which is substantially mandolin shaped and has an upper neck 2 and a lower bout 3. In at least one embodiment, the upper neck 2 is solid, has a generally square horizontal cross section, and a plurality of leg arch attaching bolts 100 protruding from a front surface of the upper neck 2. In at least one embodiment, the lower bout 3 is hollow and generally triangular with a horizontal base 4 and semi-vertical legs of equal length. The lower bout 3 has an axle bore pair 5 which is perforated through and near to the nexus of the lower bout 3 and the upper neck 2. Further, the lower bout 3 has a runner bore 6 perforated through and near to the approximate center of the horizontal base 4.

The apparatus further comprises a leg arch 7 which is generally arcuate and has a concave surface 8 and a convex surface 9 demountably attached to the upper neck 2 of the apparatus by the joining of a plurality of complimentary bolt keyholes 101 along the approximate center of the convex surface 9 to the leg arch attaching bolts 100 of the upper neck 2. The leg arch 7 has a removable leg arch pad 10 which is compressible and deformable attached to the concave surface 8.

The apparatus also comprises an elongated runner 11 which has a generally flat cross section, a curved bow end 12 and a foot plate end 13. The elongated runner 11 also has a support strut attachment bore 14 perforated through and near to the approximate center of the curved bow end 12, a main vertical body attachment bore 15 perforated through and near to the approximate center of the foot plate end 13, and a stowage bore 16 perforated through the approximate center of the elongated runner 11 and between the foot plate end 13 and curved bow end 13. A foot plate grip zone 17 which is generally rectangular in shape is attached along a top surface of the foot plate end 13 of the elongated runner 11.

In more detail, still referring to the invention of FIG. 1 to FIG. 9, the apparatus includes an extending support strut 18 which is generally cylindrical in shape and is formed by an upper exterior extension pole 19 and a lower interior extension pole 20 which are hollow thereby forming an interior void within each. The lower interior extension pole 20 is inserted into the interior void of the upper exterior extension pole 19, thereby allowing a variable sliding motion along a single shared central axis relative to and within the interior void of the upper exterior extension pole 19.

Figure 5:
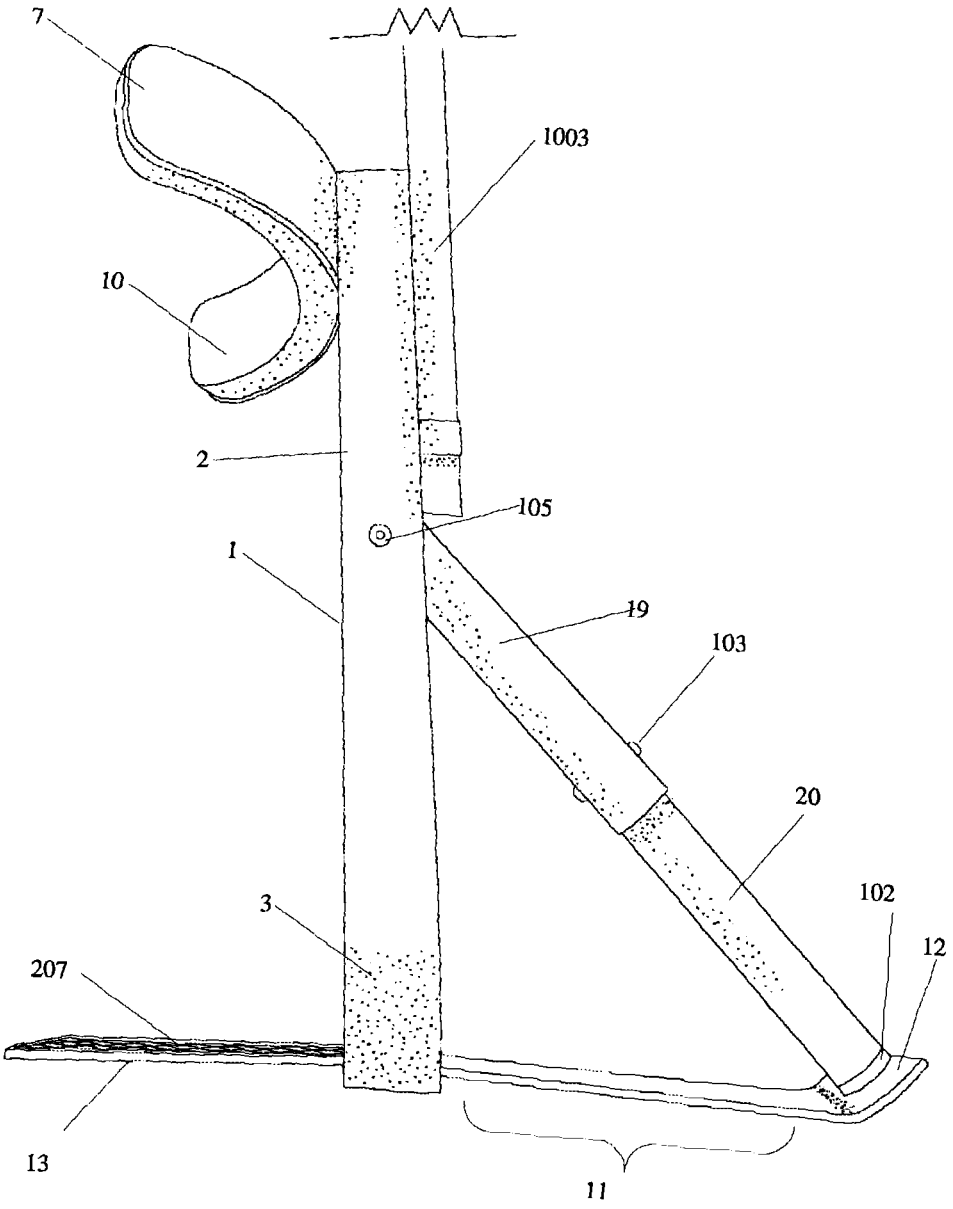
FIG. 5 is a left side elevation view of an alternate embodiment of the present invention showing a flexible pole attached to and extending from the apparatus.
Figure 6:
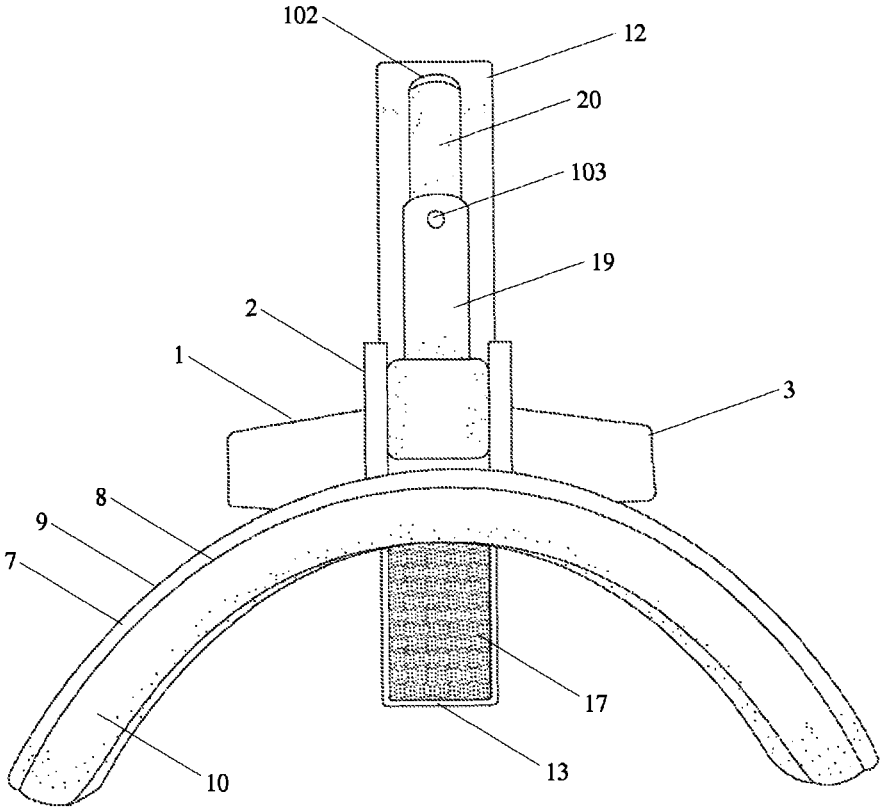
FIG. 6 is a top side elevation view of a collapsing portable apparatus for the training and adjustment of forward, lateral and rotational movement in sports activity according to the present invention.
Figure 7:
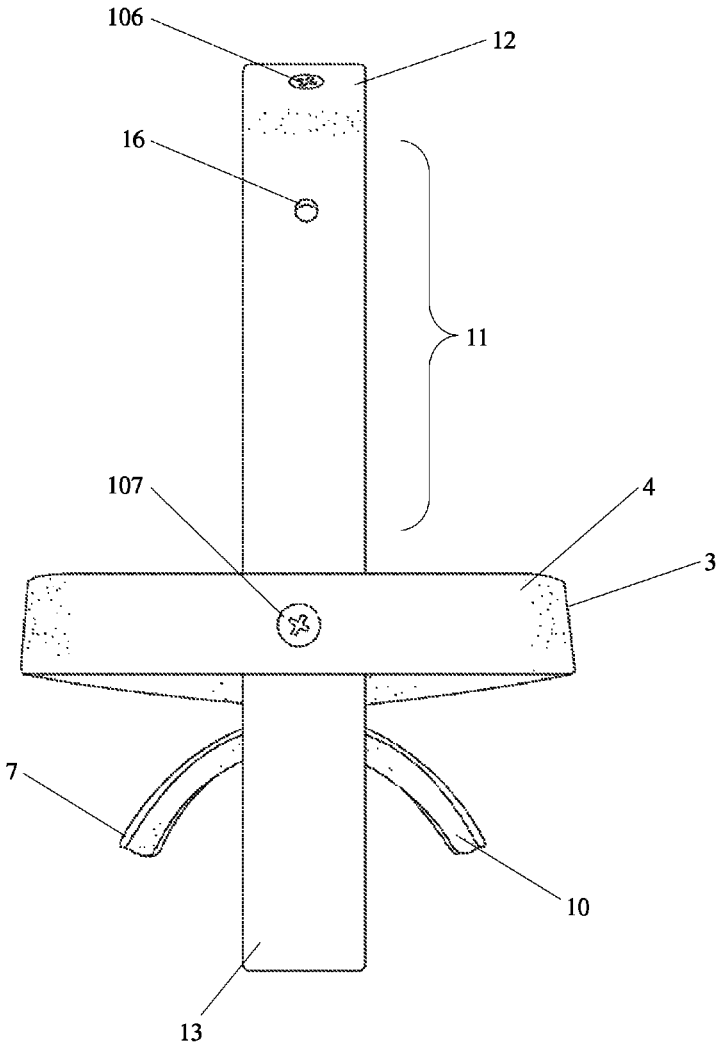
FIG. 7 is a bottom side elevation view of a collapsing portable apparatus for the training and adjustment of forward, lateral and rotational movement in sports activity according to the present invention.
Figure 8:
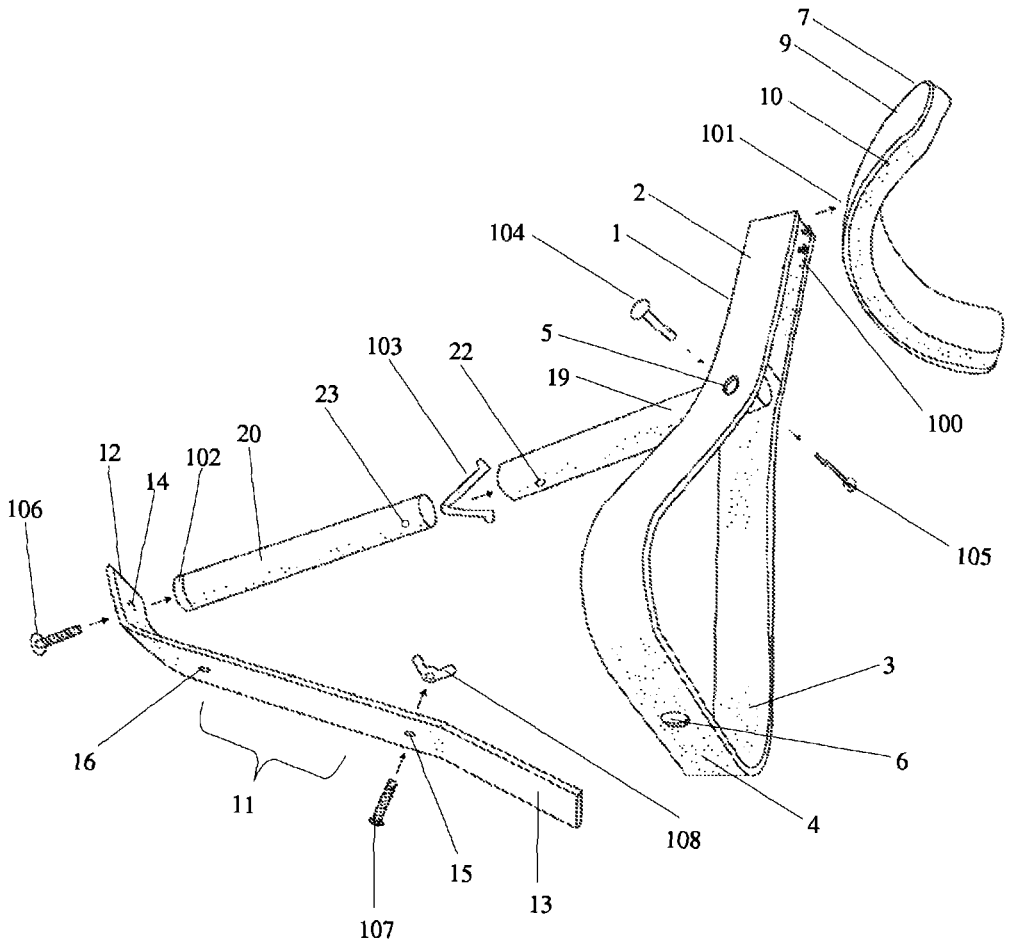
FIG. 8 is an exploded view of the present invention showing attaching means including bolts, wing nuts and internal spring clip.
Figure 9:
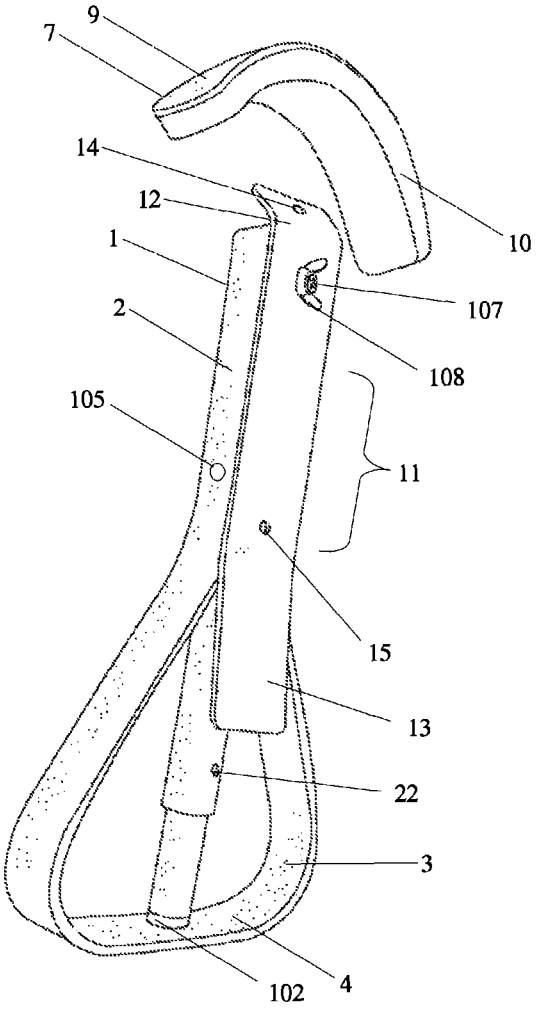
FIG. 9 is an isometric perspective view of the present invention when dissembled and collapsed when in transport, or stowage.

In more detail, still referring to the invention of FIG. 5, in an alternate embodiment, the apparatus also includes a flexible pole 1003 attached to and extending upwards from the apparatus thereby offering supplemental tactile and visual feedback to the user.

Further, the said upper exterior extension pole 19 has a pair of interior axle bore holes 21 near to an end proximal to the lower bout 3 of the apparatus when assembled and at least one pair of upper spring clip locking holes 22 near to an end distal to the lower bout 3 of the apparatus when assembled. The lower interior extension pole 20 has a pair of lower spring clip locking holes 23 near to an end proximal to the upper exterior extension pole 19 when assembled and a threaded end cap 102 inserted into an end proximal to the elongated runner 11 when the apparatus is assembled.

The device further comprises a spring clip 103 with spring clip buttons inserted into the interior void of the lower interior extension pole 20 with spring clip buttons inserted in the lower spring clip locking holes 23 and upper spring clip locking holes 22 thereby joining and locking said extending support strut 18 in an extended configuration when the apparatus is assembled.

A rivet axle 104 passes through the axle bore pair 5 of the lower bout 3 of the apparatus and through the interior axle bore 21 of the upper exterior extension pole 19 thereby fixing the upper exterior extension pole 19 to the lower bout 3 of the apparatus and allowing rotational and angular movement about the rivet axle 104 and relative to the lower bout 3. The rivet axle 104 is held in place with a complimentary receiving axle screw 105.

A first threaded bolt 106 passes through the support strut attachment bore 14 and into the threaded end cap 102 of the lower interior extension pole 20 thereby attaching the elongated runner 11 to the extending support strut 18.

A second threaded bolt 107 passes through the main vertical body attachment bore 15 of the elongated runner 11 and the runner bore 6 of the lower bout 3 of the apparatus thereby attaching the elongated runner 11 to the main vertical body 1. The second threaded bolt 107 is firmly fixed in position by a complimentary wing nut 108.

Figure 10:
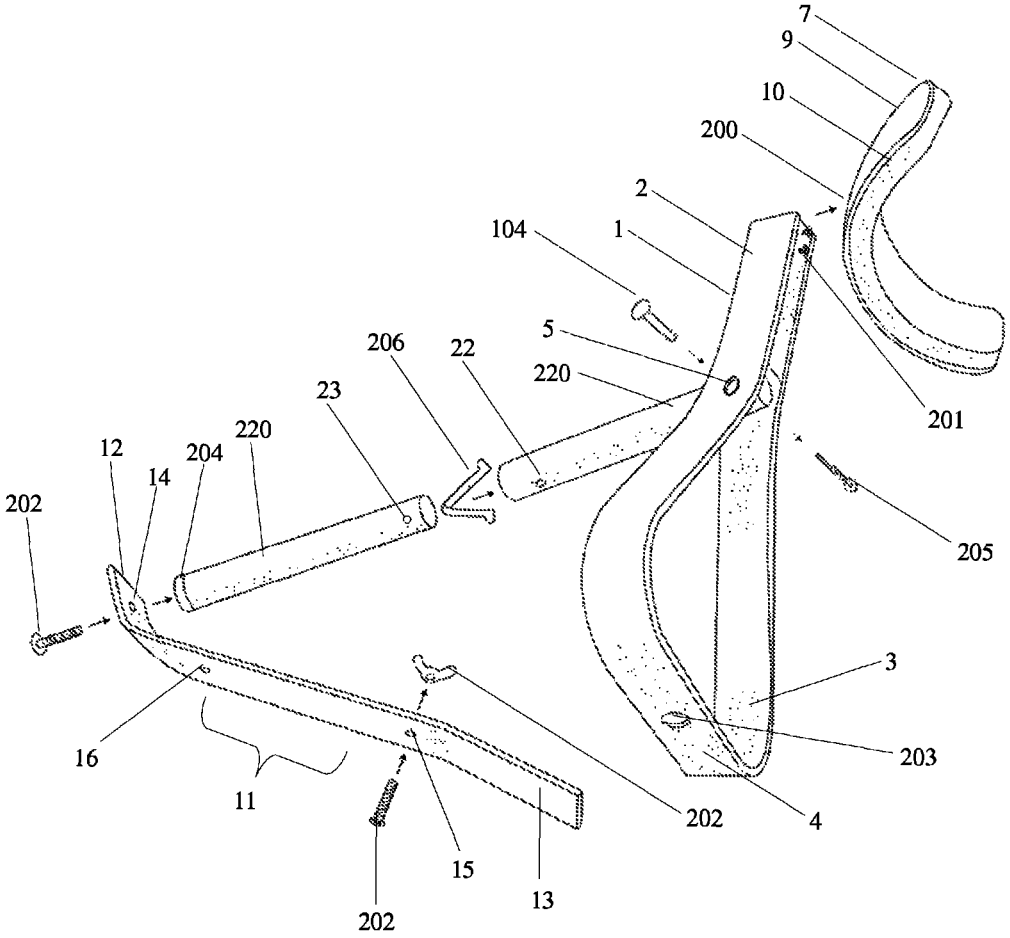
FIG. 10 is an exploded view of an alternate embodiment of the present invention showing attaching and hinge means.

Referring now to FIG. 10, in an alternate embodiment of the present invention the apparatus comprises a main vertical body 1 which has an upper neck 2 and a lower bout 3, a leg arch 7 attached to the upper neck 2 and extending forwards from the main vertical body 1, an extending support strut 18 having a proximal end attached near to the upper neck 2 extending angularly backwards from the main vertical body 1, and an elongated runner 11 having a foot plate end 13 at one end and attached to the distal end of the extending support strut 18 which is angularly disposed away from the main vertical body 1 and to the lower bout 3 of the main vertical body 1 with foot plate end 13 extending forwards.

In more detail and still referring to FIG. 10, the leg arch 7 further comprises a main vertical body receiving means 200 on the leg arch 7 which are complimentary bolt keyholes, or slots which are removably attached to the upper neck 2 at a leg arch attaching means 201 which are bolts, slots or tabs protruding from the upper neck. A removable leg arch pad 10 which is compressible and deformable is optionally attached to the leg arch 7.

The elongated runner 11 further comprises a plurality of elongated runner attaching means 202 which are bolts, nuts, tabs, slots, cotter pins, and clevis pins, which are removably attached to the main vertical body 1 at a first elongated runner receiving means 203 which are complimentary bores, bolts, nuts, tabs, slots, cotter pins and clevis pins. The elongated runner 11 further comprises a plurality of elongated runner attaching means 202 which are bolts, nuts, tabs, slots, cotter pins, and clevis pins, which are removably attached to the extending support strut 18 at a second elongated runner receiving means 204 which are complimentary bolts, nuts, tabs, slots, cotter pins and clevis pins.

A foot plate grip zone 17 is attached to the top surface of the elongated runner 11. The foot plate grip zone 17 has a gripping means 24 which are dimensional cleats, groves, treads, grit or non-slip coating.

In more detail and still referring to FIG. 10, the extending support strut 18 is attached to the main vertical body 1 by a hinge means 205 which is a flexible crease, rivet axle and axle screw, dowel, nut and bolt, threaded axle or clevis pin and cotter pin. The hinge means 205 thereby allows the extending support strut 18 to angularly swing about an axis created at the nexus of the extending support strut 18 and the main vertical body 1.

In an alternate embodiment of the present invention, the extending support strut 18 is telescopic, made of a plurality of concentric tubular sections 220 which slide into and relative to each other thereby allowing the extending support strut 18 to shorten and lengthen. The concentric tubular sections 220 allows a user to fix the 220 tubular sections in a rigid disposition by a tightening means 206 which is a plurality of spring clips, tightening collars, screw collar or fitting.

Figure 12:
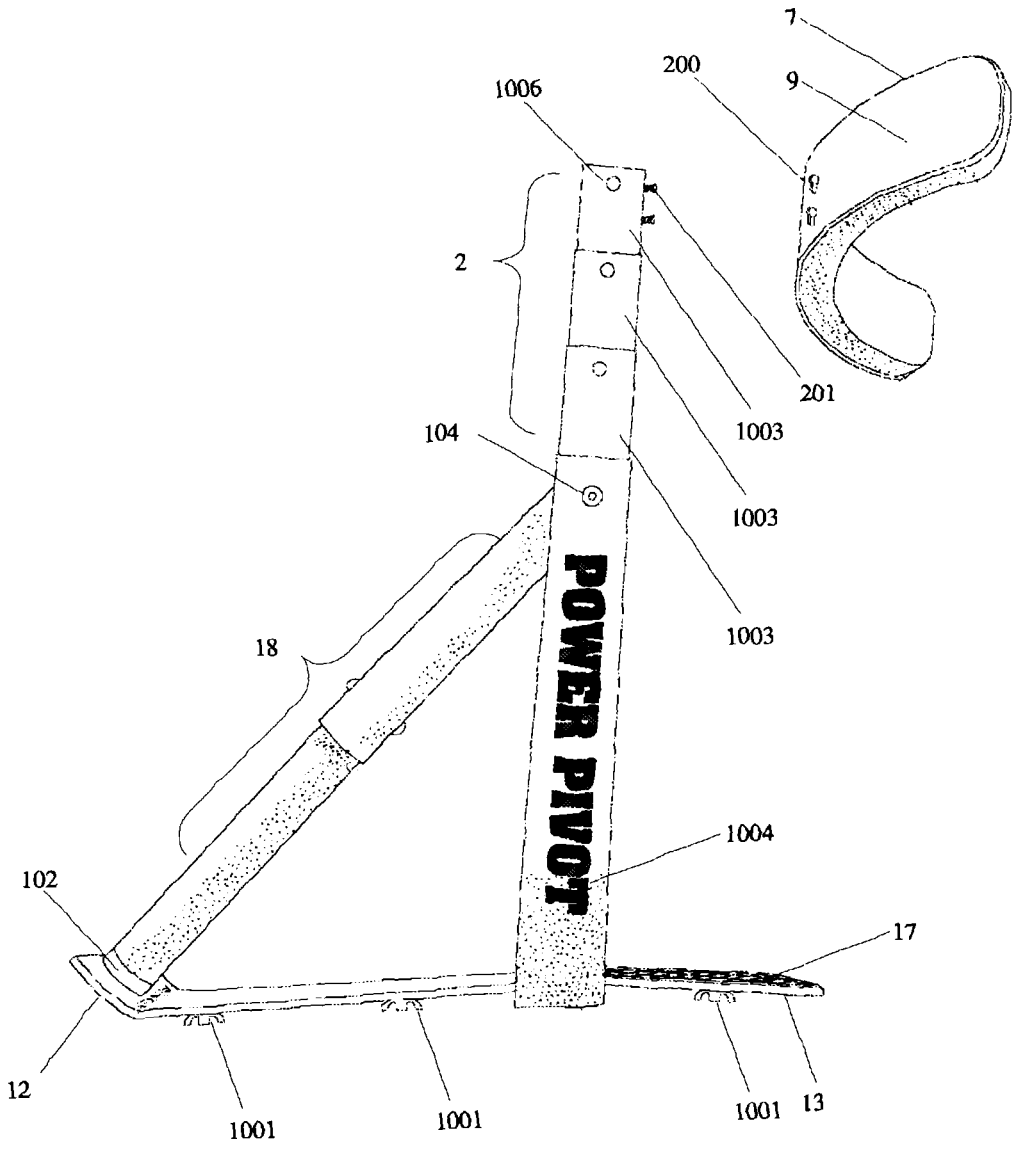
FIG. 12 is a right elevation view of an alternate embodiment of the present invention showing a telescopic upper neck, tightening means, cleats extending from the elongated runner, main vertical body receiving means and decorative element.

Referring now to FIG. 12, in an alternate embodiment of the present invention, the upper neck 2 is telescopic, made of a plurality of concentric neck tubular sections 1003 which slide into and relative to each other thereby allowing the upper neck 2 to shorten and lengthen. The upper neck tubular sections 1003 allows a user to fix the sections in a rigid disposition by a neck tightening means 1006 which is a plurality of spring clips, tightening collars, screw collar or fitting. The leg arch 7 is detached from the upper neck 2, thereby showing the main vertical body receiving means 200 of the leg arch 7.

In an alternate embodiment, the apparatus is collapsible, presenting in a generally planar orientation when collapsed or dissembled for easy stowage or transport.

In at least one embodiment, the invention further comprises the placement or printing of a decorative element 1004 on the exterior of the device, which can be a pattern, text, an image, advertisement or equivalent.

The apparatus according to the present invention can be made of lightweight and strong materials including plastic or metal. Although no dimensions are claimed it is envisioned that this device be of a size that corresponds with a wide range of athlete leg dimensions.

In an alternate embodiment of the present invention a plurality of cleats 1001, which can be retractable, extend from the horizontal base 4 and elongated runner 11 for insertion into the ground thereby increasing the stability of the apparatus while in use.

In at least one embodiment, a flexible pole 1005 is attached to and extends upwards from the apparatus thereby offering supplemental tactile and visual feedback to the user while in use.

In order to assemble a collapsing portable apparatus for the training and adjustment of forward, lateral and rotational movement in sports activity from a collapsed state, the user transports the device to the environment where sports training activity is to be performed. The first threaded bolt 106 and second threaded bolt 107 are unscrewed from the collapsed apparatus. The wing nut 108 is unscrewed from the second threaded bolt 107. Next, the user removes the elongated runner 11 from the collapsed apparatus, and swings the extending support strut 18 backwards thereby creating an angle between the extending support strut 18 and the main vertical body 1 of the apparatus.

Next the user extends the extending support strut 18 by pulling upon the lower interior extension pole 20, and fixing the interior extension pole 20 in an extended position by locking a spring clip 103 located in the interior extension pole into a plurality of upper spring clip locking holes 22 located on the upper exterior extension pole 19 of the apparatus.

The elongated runner 11 is then fixed to the main vertical body 1 by passing the second threaded bolt 107 through a runner bore 6 of the vertical main body 1 and a main vertical body attachment bore 15 of the elongated runner 11. The second threaded bolt 107 is tightened with a wing nut 108.

Next the user aligns the threaded end cap 102 of the extending support strut 18 with a support strut attachment bore 14 on the elongated runner 11 and fixes the extended support strut 18 to the elongated runner 11 by passing the first threaded bolt 106 through the support strut attachment bore 14 and screwing the first threaded bolt 106 into the threaded end cap 102. The user attaches the leg arch 9 to a plurality of leg arch attaching bolts 100 on the neck 2 of the main vertical body 1. Lastly, the user may optionally dissemble and collapse the device for stowage when not in use.

Figure 11:
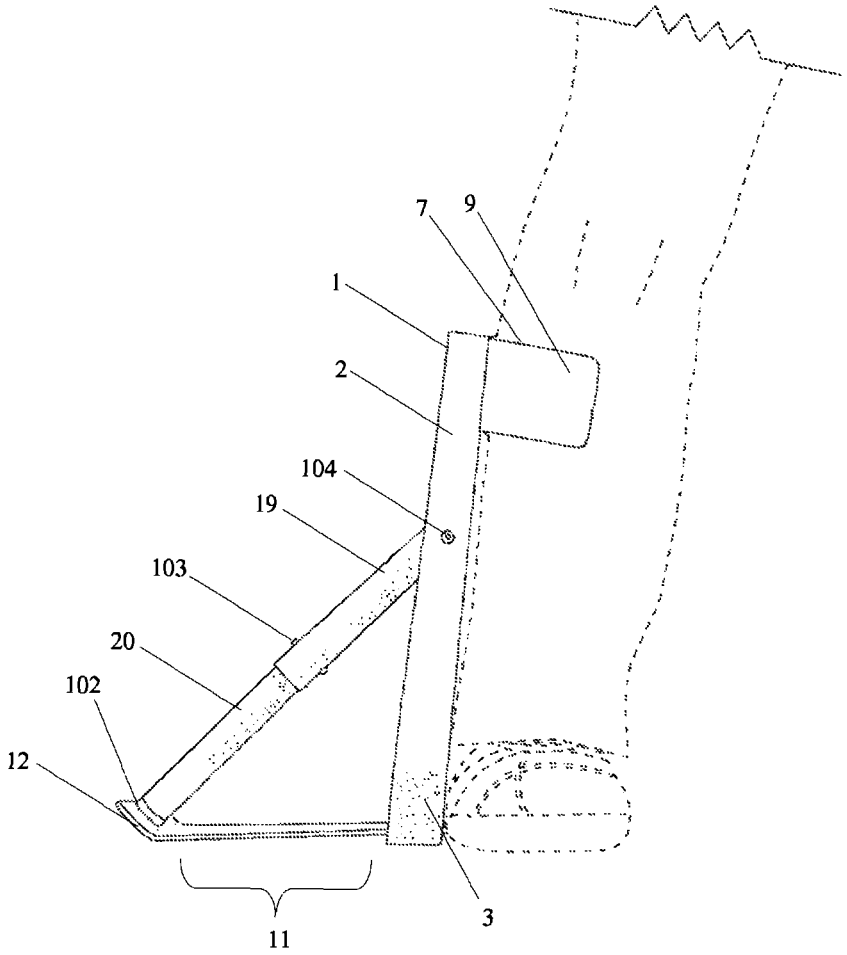
FIG. 11 is a front elevation view of the present invention in its environment while in use with a sports player engaging with the apparatus with foot on the foot plate and upper shin within the leg brace thereby restricting undesirable forward, lateral and rotational movement of the player's body and leg.

Referring now to FIG. 11, in order to use the apparatus for the training and adjustment of forward, lateral and rotational movement in sports activity during training exercises, a user who is a training athlete first places the assembled apparatus on a training surface such as a golf green or batter's box. The user then places an arch of her foot onto the foot plate end 13 of the apparatus. Next the user places her lower leg into the leg arch 7 attached to the main vertical body 1 of the apparatus. The user then adjusts the placement of her foot and lower leg to snugly join the leg arch 7 thereby yielding tactile feedback from the apparatus to the athlete user.

With the user's leg in contact with the apparatus, she begins a sports activity which can be a golf swing, down stroke, or swing of a baseball bat. While training the user can learn from the tactile feedback of the apparatus on the lower leg to note and adjust unwanted forward, lateral and rotational movement during the activity. The user repeats the sports activity while utilizing the tactile feedback of the apparatus until undesirable movement is eliminated.

The previously described versions of the present invention have many advantages including and without limitation, the properties of being i) portable, ii) adjustable, iii) collapsible when not in use, iv) not attached to the user's body, v) stops unwanted forward, lateral and rotational movement, vi) provides tactile feedback for learning while training, vii) immediately provides the user with positive feedback, viii) initiates resistance necessary to hit a ball correctly, and ix) can be used indoors, in practice areas, or in the field. The device of the present invention is believed to accomplish all of the foregoing objectives. The invention does not require that all the advantageous features and all the advantages need to be incorporated into every embodiment of the invention.

Although the present invention has been described in considerable detail with reference to certain preferred versions thereof, other versions are possible. Therefore the spirit and scope of the appended claims should not be limited to the description of the preferred versions contained therein.

The reader's attention is directed to all papers and documents which are filed concurrently with this specification and which are open to public inspection with this specification, and the contents of all such papers and documents are incorporated herein by reference.

All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. As for "means for" elements, the applicant intends to encompass within the language any structure presently existing or developed in the future that performs the same function. The invention should therefore not be limited by the above described embodiment, method, and examples, but by all embodiments and methods within the scope and spirit of the invention.

What is claimed is:

1. A collapsing portable apparatus for the training and adjustment of forward, lateral and rotational movement in sports activity which comprises a) a main vertical body which is substantially mandolin shaped having an upper neck and a lower bout, said upper neck is solid and having a generally square horizontal cross section with a plurality of leg arch attaching bolts protruding from a front surface of the upper neck, said lower bout is hollow and generally triangular having a horizontal base and semi-vertical legs of equal length, said lower bout having an axle bore pair perforated through and near to a nexus of the lower bout and the upper neck, said lower bout having a runner bore perforated through and near to an approximate center of the horizontal base;

b) a leg arch which is generally arcuate and having a concave surface and a convex surface demountably attached to the upper neck of the apparatus by the joining of a plurality of complimentary bolt keyholes along an approximate center of the convex surface to the leg arch attaching bolts of the upper neck, said leg arch having a removable leg arch pad which is compressible and deformable attached to the concave surface, c) an elongated runner having a generally flat cross section, a curved bow end and a foot plate end, said elongated runner having a support strut attachment bore perforated through and near to an approximate center of the curved bow end, a main vertical body attachment bore perforated through and near to an approximate center of the foot plate end, and a stowage bore perforated through an approximate center of the elongated runner and between the foot plate end and curved bow end, said elongated runner having a foot plate grip zone which is generally rectangular in shape and is attached along a top surface of the foot plate end, d) an extending support strut which is generally cylindrical in shape and is formed by an upper exterior extension pole and a lower interior extension pole which are hollow thereby forming an interior void within each, said lower interior extension pole inserted into the interior void of the upper exterior extension pole thereby allowing variable sliding motion along a single shared central axis relative to and within the interior void of the upper exterior extension pole, said upper exterior extension pole having at least one pair of interior axle bore holes near to an end proximal to the lower bout of the apparatus when assembled and a pair of upper spring clip locking holes near to an end distal to the lower bout of the apparatus when assembled, said lower interior extension pole having a pair of lower spring clip locking holes near to an end proximal to the upper exterior extension pole when assembled and a threaded end cap inserted into an end proximal to the elongated runner when the apparatus is assembled, e) a spring clip with spring clip buttons inserted into the interior void of the lower interior extension pole with spring clip buttons inserted in the lower spring clip locking holes and upper spring clip locking holes thereby joining and locking said extending support strut in an extended configuration when the apparatus is assembled, f) a rivet axle passing through an exterior axle bore of the lower bout of the apparatus and through the interior axle bore holes of the upper exterior extension pole thereby fixing the upper exterior extension pole to the lower bout of the apparatus and allowing rotational and angular movement about the rivet axle and relative to the lower bout, said rivet axle is held in place with a complimentary receiving axle screw, g) a first threaded bolt passing through the support strut attachment bore and into the threaded end cap of the lower interior extension pole thereby attaching the elongated runner to the extending support strut, and h) a second threaded bolt passing through the main vertical body attachment bore of the elongated runner and the runner bore of the lower bout of the apparatus thereby attaching the elongated runner to the main vertical body, said second threaded bolt firmly fixed in position by a complimentary wing nut.

2. The device as in claim 1 further comprising a plurality of cleats extending from the horizontal base and elongated runner for insertion into the ground thereby increasing the stability of the apparatus while in use.

3. The device as in claim 1 further comprising a flexible pole attached to and extending upwards from the apparatus thereby offering supplemental tactile and visual feedback to the user.

4. A method of assembling a collapsing portable apparatus for the training and adjustment of forward, lateral and rotational movement in sports activity from a collapsed state which comprises a) transporting the device to an environment where sports training activity is to be performed, b) unscrewing a first threaded bolt from the collapsed apparatus, c) unscrewing a second threaded bold from the collapsed apparatus, d) unscrewing a wing nut from the second threaded bolt, e) removing an elongated runner form the collapsed apparatus, f) swinging an extending support strut backwards thereby creating an angle between the extending support strut and a main vertical body of the apparatus, g) extending the extending support strut by pulling upon a lower interior extension pole, h) fixing the interior extension pole in an extended position by locking a spring clip located in the interior extension pole into a plurality of upper spring clip locking holes located in an upper exterior extension pole of the apparatus, i) fixing the elongated runner to the main vertical body by passing the second threaded bolt through a runner bore of the vertical main body and a main vertical body attachment bore of the elongated runner, j) tightening the wing nut onto the second threaded screw, k) aligning a threaded end cap of the extending support strut with a support strut attachment bore on the elongated runner, l) fixing the extended support strut to the elongated runner by passing the first threaded bolt through the support strut attachment bore, m) screwing the first threaded bolt into the threaded end cap, and n) attaching a leg arch to a plurality of leg arch attaching bolts on the main vertical body.

5. The method of claim 4 further comprising dissembling the device for stowage when not in use.

* * * * *